United States Patent [19]

Davis, Jr.

[11] 4,005,923

[45] Feb. 1, 1977

[54] CHRISTMAS TREE LIGHTING SERIES

[76] Inventor: George B. Davis, Jr., 7512 Marbury Road, Bethesda, Md. 20034

[22] Filed: Feb. 20, 1976

[21] Appl. No.: 659,900

[52] U.S. Cl. ..... 339/157 C; 240/10 T; 339/63 R; 339/206 R

[51] Int. Cl.[2] ..... H01R 11/02

[58] Field of Search ..... 240/10 T; 339/63 R, 339/63 M, 154 R, 154 A, 154 L, 156 R, 156 T, 157 R, 157 C, 196 R, 196 M, 198 H, 206 R, 206 P

[56] References Cited

UNITED STATES PATENTS

| | | | |
|---|---|---|---|
| 1,974,472 | 9/1934 | Seghers | 339/157 C |
| 2,071,948 | 2/1937 | Peters | 339/157 C |
| 2,827,617 | 3/1958 | Odegaard | 339/154 R |
| 3,344,392 | 9/1967 | Briscoe | 339/63 R |

*Primary Examiner*—Roy Lake
*Assistant Examiner*—Mark S. Bicks

[57] ABSTRACT

This invention relates generally to Christmas tree lighting and particularly to a series string of Christmas tree lights wherein the series loop may be temporarily opened by separating the plug connector to permit untangling of the string and thereafter the loop restored for operatively connecting with a power source by again plugging together the halves of the connector.

5 Claims, 5 Drawing Figures

CHRISTMAS TREE LIGHTING SERIES

It is an object of the present invention to provide for opening a series connected lighting loop by separating the connector plug of the loop.

A further object is to enable a lighting series loop to be opened to more easily arrange the lights upon a tree and whereupon after the lamps are substantially in place and the loop connected and lighted, the final positioning of the lamps may be more readily effected.

A still further object is to enable the series loop of a Christmas tree lighting string to be opened while the string is still upon the tree to permit the string to be quickly and easily removed from the tree without tangling with other strings upon the tree.

A further object is to provide a connector plug for a series string of Christmas tree lights that has a bright and different color from the wire of the series thusly to enable the free ends of the string, after the plug has been separated, to be more readily detected and thereby to more effectively facilitate an untangling operation.

Another object is to enable the loop of a lighting series to be opened to form an inline string which is more easily wound upon a cardboard or rolled paper support for storage and thereafter unwound for use without the tangling hazard generally accompanying the storing of lighting series of this type.

To better understand the advantages of the present invention, reference is now made to the accompanying drawing wherein.

Figure 5:
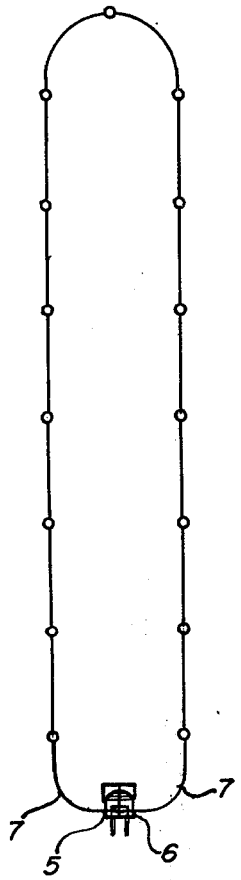
FIG. 5 is a view of a lighting series as including the connector plug of the device.
Figure 2:
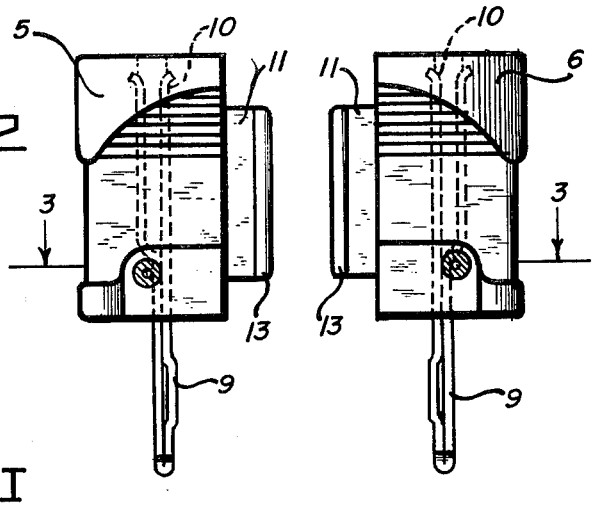
FIG. 2 is a plan view in elevation of the connector as separated but in position for plugging together.
Figure 1:
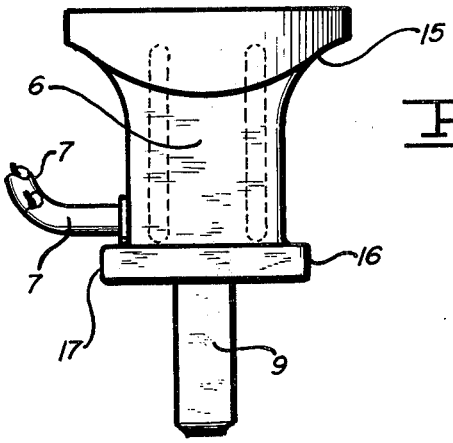
FIG. 1 is a side view in elevation of the plug connector of the lighting series of FIG. 5.
Figure 4:
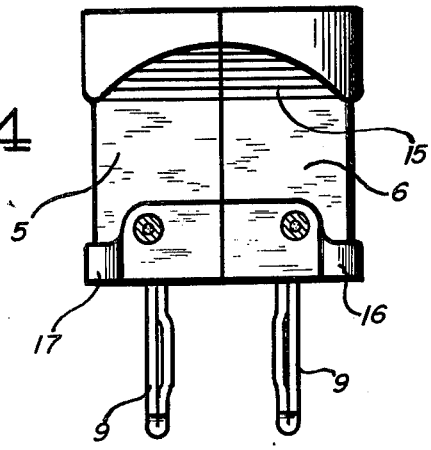
FIG. 4 is a plan view of the connector of FIG. 2 as plugged together.

Referring now to the drawings and more particularly to FIGS. 1 and 2 thereof, wherein is shown the connector plug of the lighting series of FIG. 5 and wherein the two halves of the plug are shown as assembled together to form what appears to be a conventional plug connector for connecting the lighting series to a conventional power supply outlet.

Figure 3:
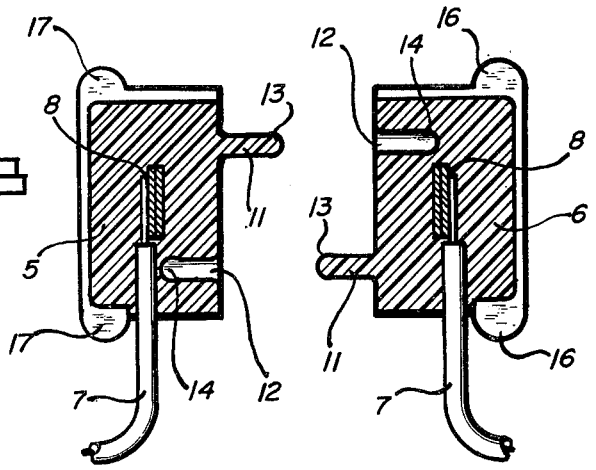
FIG. 3 is a view in cross-section as taken along 3—3 of FIG. 2.

In FIGS. 2 and 3 the halves 5 and 6 of the connector are shown as separated and as molded over the ends of the series loop and into which the wires 7 of the series extend to connect with the terminal prongs of the connector as at 8. These terminals are of the conventional through type with the projecting portion 9 thereof closed for extending into and connecting with a conventional power supply outlet with the open end 10 within the body of the connector positioned for receiving the prongs of a similar type plug connector.

Formed preferably as an integral molded extension from each connector half 5 and 6 is a tongue like projection 11 that is so configerated and positioned as to engage in locking engagement similarily formed recesses 12 provided therefor within the other half of the connector as shown. These tongue like members 11 preferably include a somewhat enlarged end portion 13 which serves to engage and lock with similar formed enlargements 14 provided within each of the recesses 12 and by means of which the halves of the plug are securely held together during normal use of the device. The material of the connector is one of the many forms of semi-hard plastic which will yield sufficiently to allow the ready coupling of the halves of the plug together.

While the tongues 13 are herein shown as integral molded parts of the plug connector halves 5 and 6, these locking members may be formed separately from the plug body or in the form of metallic or plastic pins or studs that are preferably anchored to one of the connector halves and positioned for being frictionally received within conforming recesses provided within the other connector half. The primary requirement of these locking members being that with the connector assembled together, the halves of the connector cannot be separated until the connector has been removed from a power supply outlet.

Desirably, the molded halves are so formed as to include the surfaces 15 which serves to assist withdrawing the plug from a supply outlet while the extending portions 16 and 17 thereof, assist in gripping the plug halves to assist in separating the plug.

In operation, the series loop 18 would normally come with the plug assembled as shown in FIG. 5 and whereupon the string may be conventionally arranged upon a tree to be lighted, however, when removing the string and where several strings may be overlapping in their placement upon the tree, such a plug is highly desirable in that it allows a series loop to be opened and the plug halves threaded through the other strings upon the tree as required to quickly separate each string without the usual tangle and bother.

A further advantage of the present device is the ease with which a snarled string or strings may be untangled. The plug is simply separated and the now free ends of the series loop are drawn through the tangled strings as required to quickly extract the string and eliminate the tangle. Generally the untangling of two or more 35 or 50 light strings can become an almost insurmountable task and which usually requires cutting and splicing the strings or totally discarding the strings as is frequently the case.

While herein is shown one simple form of the invention that has proven satisfactory, it is understood that other ways may be employed to separate the connector plug of a series loop without departing from the spirit and scope of the device as herein shown.

What I therefore claim and desire to cover by letters patent is:

1. A two prong electrical connector for connecting electrical apparatus to a two conductor electrical outlet comprising, an insulating housing of two separatable halves, a connector prong mounted in and extending from each half of said housing and to which may be connected said apparatus and with the longitudinal axes of said prongs disposed substantially parallel with each other when said connector halves are attached together, means forming at least one recess in one half of said housing, means forming at least one projection extending from the other half of said housing with the axes of said recess and projection disposed substantially transverse to the longitudinal axes of said connector prongs and with said recess and projection positioned to engage in a manner to secure said connector halves together by movement of said connector halves in a direction substantially transverse to the longitudinal axes of said connector prongs and prevent separation of said connector halves except by movement of said connector halves along a plane lying substantially transverse to the longitudinal axes of said connector prongs.

2. An electrical connector as claimed in claim 1 wherein said apparatus is a string of series connected lights of which the terminal ends of said series are respectively connected to the terminal prongs of said connector.

3. An electrical connector as claimed in claim 2 wherein the connector halves are formed as moldings about the respective ends of said series.

4. An electrical connector as claimed in claim 1 wherein said recess and projection includes means for releasably locking the said connector halves together.

5. An electrical connector as claimed in claim 1 wherein each half of the said housing includes an additional recess into which may be inserted the terminal prongs of a similar type connector for respectively engaging electrically a portion of said terminal prongs within said connector halves.

* * * * *

UNITED STATES PATENT OFFICE

CERTIFICATE OF CORRECTION

Patent No. 4,005,923 Dated Feb. 1, 1977

Inventor(s) GEORGE B. DAVIS JR.

It is certified that error appears in the above-identified patent and that said Letters Patent are hereby corrected as shown below:

Column 3 line 7 change [terminal] to --connector--.

Column 4 line 9 change [terminal] to ---connector--.

column 4 line 11 change [terminal] to ---connector--.

Signed and Sealed this

Nineteenth Day of April 1977

[SEAL]

*Attest:*

RUTH C. MASON
*Attesting Officer*

C. MARSHALL DANN
*Commissioner of Patents and Trademarks*